US009145668B2

(12) United States Patent
Molina

(10) Patent No.: US 9,145,668 B2
(45) Date of Patent: Sep. 29, 2015

(54) GRAVITY DRAINED, WASTE MANAGEMENT MECHANISM

(76) Inventor: Arnold Molina, Winnetka, CA (US)

( * ) Notice: Subject to any disclaimer, the term of this patent is extended or adjusted under 35 U.S.C. 154(b) by 791 days.

(21) Appl. No.: 13/199,803

(22) Filed: Sep. 9, 2011

(65) Prior Publication Data

US 2012/0066826 A1 Mar. 22, 2012

Related U.S. Application Data

(60) Provisional application No. 61/403,129, filed on Sep. 10, 2010.

(51) Int. Cl.
*E03D 11/10* (2006.01)
*E03D 11/18* (2006.01)

(52) U.S. Cl.
CPC ..... *E03D 11/18* (2013.01)

(58) Field of Classification Search
CPC ..... E03D 11/10; E03D 11/14; E03D 11/18
USPC ..... 4/441
See application file for complete search history.

(56) References Cited

U.S. PATENT DOCUMENTS

| | | | | |
|---|---|---|---|---|
| 2,817,092 | A * | 12/1957 | Hahn | 4/323 |
| 4,165,109 | A * | 8/1979 | Foti | 285/148.26 |
| 5,505,498 | A * | 4/1996 | Halling et al. | 285/111 |
| 6,195,810 | B1 * | 3/2001 | Minamiyama et al. | 4/420 |
| 2007/0094783 | A1 * | 5/2007 | Wen | 4/421 |
| 2009/0320200 | A1 * | 12/2009 | Mukerji | 4/441 |

* cited by examiner

*Primary Examiner* — Janie Christiansen
(74) *Attorney, Agent, or Firm* — Colin P. Abrahams

(57) ABSTRACT

The invention is for a toilet and drainage assembly comprising a bowl having an outlet pipe having an axis, and a waste depository pipe coaxial with the axis with an inlet opening. A water trap is located between the outlet pipe and the inlet opening of the waste depository pipe, and comprises a bowl connector section connectable to the outlet pipe, a waste depository connector section connectable to the inlet opening of the waste depository pipe, and an intermediate section having a nonlinear component between the bowl connector section and the waste depository section. A mechanism moves the water trap between a first position in which the nonlinear component of the intermediate section is above the axis and a second position in which the nonlinear component of the intermediate section is substantially at the axis.

17 Claims, 7 Drawing Sheets

GRAVITY DRAINED, WASTE MANAGEMENT MECHANISM

CROSS-REFERENCES TO RELATED APPLICATIONS

I do here claim the benefits of my previously filed, provisional utility patent application No. 61/403,129 filing date: Sep. 10, 2010 entitled "TANKLESS FLUSHLESS TOILET". I do claim this application as the corresponding non-provisional patent application completing the application for this newly named invention the "GRAVITY DRAINED, WASTE MANAGEMENT MECHANISM".

BACKGROUND OF THE INVENTION

FIGS. 1 and 2 show a conventional toilet bowl configuration. Every plumbing fixture in service must be provided with a water seal to block sewer gases from coming up through the plumbing system A14, and entering the building through the plumbing fixtures A1 the water closet or the lavatory sink A15.

Most plumbing fixtures have the water seal provided by a P-trap A27 made of drainage fittings, connected to the drain A16 at the bottom of the fixture as in the lavatory sink A15. Waste passes through the drain A16, to the tail piece A17, and into the P-trap.

The water seal is the hatched area in the P-trap, beginning at the weir of the water seal A18 at the inlet of the trap and going down to the lowest point A19 in the trap and water seal, then to the weir A20 of the water seal at the outlet of the trap. The waste then goes over the weir of the trap A21 and through the dirty arm A22 and enters the inlet branch of the sanitary-tee A23.

The inlet then sweeps down 90 degrees in an arc to the waste outlet branch A24 of the sanitary-tee where the waste enters the sewer system. The third branch of the sanitary-tee is the vent branch A25 and it combines with the vent branch of the toilet A12 and travels vertically up through the roof where the vent A26 terminates and the sewer gases are allowed to dissipate harmlessly in the open atmosphere above the building.

The toilet however does not have its water seal provided by a P-trap constructed of drainage fittings connected to the toilet at the bottom of the fixture as the sink in A15 does in FIG. 1. But it has its water seal provided by an internal water trap, incorporated in the casting of the toilet bowl itself. This is identified by the hatched area of the toilet bowl in FIG. 1 & FIG. 2.

In these drawings A2 identifies the weir of the water seal in the toilet bowl, A3 identifies the lowest point of the water seal in the water trap of the toilet bowl and A4 identifies the weir of the water seal in the water trap of the toilet bowl. And A7 is the weir of the water trap itself. A1 identifies the toilet bowl itself and A5 the toilet tank itself.

After passing through the toilet bowl A1 and the waste depository A9, the waste is deposited vertically into the closet bend A10, which is connected to the bottom of the toilet bowl. This drainage fitting has no water trap and provides no water. It conveys the waste to the inlet branch A11 of the unitary-tee, the waste then passes through A13 the outlet branch of the sanitary-tee and into the sewer system A14.

For over 200 years water closets have been flushed with water from toilet tanks A5 and flushometer valves, which use the hydro-mechanics of flushing to push the contents of the toilet bowl through the internal water trap A6, and over the weir of the water trap A7, following the arrows A8 through the water trap to the waste depository A9 or 9 in FIGS. 3 to 6.

Leaving the bottom of the toilet the contents are deposited into the closet bend A10, which conveys the waste to the inlet branch A11 of the sanitary-tee and down into the sewer system A14. In effect flushing raises the waste over the weir of the trap in order to flow down hill to the sewer. And A12 is the vent branch of the sanitary-tee.

In the field of reducing the amount of water used to accomplish this function of draining the contents of the toilet bowl, all efforts have been focused on improving the efficiency of the flushing action and not finding a more efficient mechanism to accomplish this critical function.

Only the force of gravity exerted on the waste itself is needed to drain a tub a shower or a kitchen sink, and there must be a more efficient means to drain the contents of the toilet. Certainly sewer gases must be prevented from entering the building, and the water seal maintained. But pushing the waste up-hill makes no sense. There must be a way and means of using the force of gravity to our advantage.

If I deposit 2 ounces of waste then use 200 ounces of clean potable water to flush it to the sewer that makes no sense and is totally inefficient. There must be a way and means of using the force of gravity to drain the waste down hill as for all other plumbing fixtures, instead of fighting gravity up-hill, the way it does with the water closet.

BRIEF SUMMARY OF THE INVENTION

If I take a tall glass of water and hold it vertically the water stays in the glass. But when I turn the glass 90 degrees from the vertical to the horizontal position the water drains from the glass needing only the force of gravity exerted on the water itself.

My invention for replacing the flush toilet or the water closet is the gravity drained, waste management mechanism. This mechanism has no water tank and does not flush, the draining cycle needs no flush to clear the bowl and trap of waste. In toilets, flushing only pushes the contents of the bowl through the trap 6 and over the weir of the trap 7. It's this up and over that is the problem, it's fighting against gravity. Instead my design uses gravity to empty the waste by lowering the weir of the trap below the lowest point in the water seal 3. The water seal is that part of the trap that is identified. by hatching, starting at 2, down to 3 and up to 4.

The means by which I accomplish lowering the weir of the trap, is by isolating the water trap from the toilet bowl and casting it separately. I reconfigure the pathway 8 of the trap to resemble a question mark on it's side. So now instead of the pathway to the sewer going down the bowl up the trap and down into the sewer, as in FIG. 1, the new pathway goes down up and around. The new slipjoint water trap is then connected to the toilet bowl using two slipjoint connecters 19 & 20. The toilet bowl outlet 10 mates with the slipjoint water trap inlet 13 and the slipjoint water trap outlet 17 mates with the waste depository inlet 14. The faces 11 & 12 and faces 15 & 16 are each parallel to the others and share a common axis 18. This designed arrangement of the toilet bowl and the slipjoint water trap allows the trap to rotate on its common axis 90 degrees from the vertical and in doing so it dis-establishes the weir of the trap. Without a weir the contents do not dam up, but flow downhill all the way through the toilet to the sewer system, without flushing, needing only the force of gravity exerted on the contents itself to flow downhill.

The mechanism I have designed to accomplish the function of rotating the slipjoint water trap is a long handle firmly attached to the back of the toilet bowl, about 10" above the floor. This is the pivot point 30 of the handle. 2" above the floor the draw down cable attaches to the handle. When the handle is moved counter clockwise the cable 26 is drawn through the two cable guides 27 & 28, seen in FIG. 6 and this movement draws down the slipjoint water trap so that it rotates on it's common axis and the draining function is accomplished. Releasing handle allows return spring mechanism 22 to return the slipjoint water trap to the vertical position and the water seal can then be re-established, by the toilet handle triggering the water supply valve to release water.

BRIEF DESCRIPTION OF THE SEVERAL VIEWS OF THE DRAWINGS

FIGS. 1 & 2 help provide background for the invention and the prior state of the technology.

DETAILED DESCRIPTION OF THE INVENTION

Figure 2:
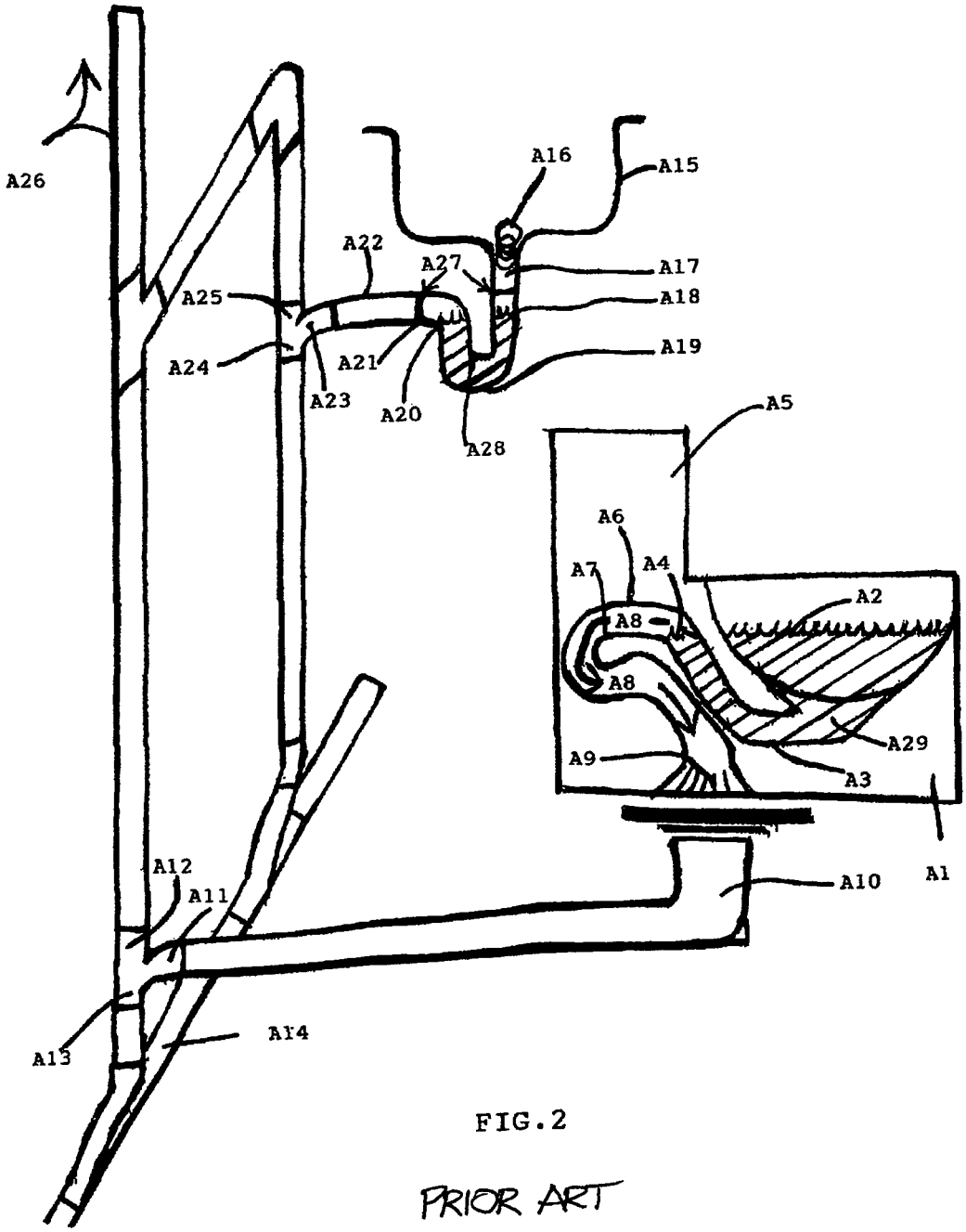
FIG.2 PRIOR ART
FIG. 2 Is an isometric drawing of rough-in drainage piping provided to a lavatory sink and for the water closet.
Figure 3:
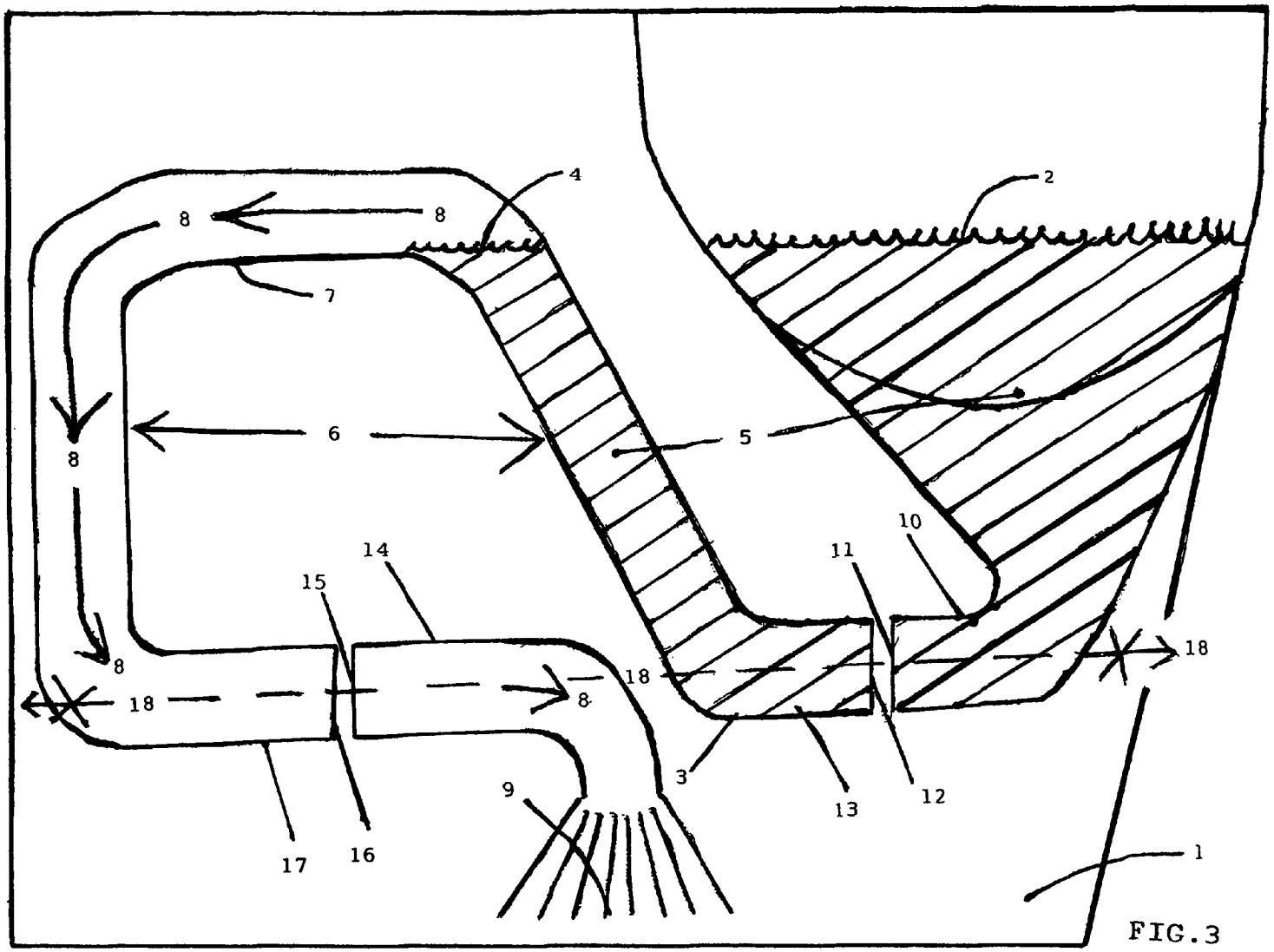
FIG. 3 Is a side elevation view of my design for the improvement of the water closet. It shows my two innovative changes to the toilet bowl. The pathway taken by the water trap to reach the sewer is reconfigured. Then the water trap is a separated and distinct piece caste separately from the toilet bowl designed to be connected to the bowl along the common axis 18.

All plumbing fixtures are required to have water seals provided to each plumbing fixture, to prevent sewer gases from rising up through the plumbing and entering the building. The common method for providing water seal protection for a lavatory basin is illustrated in FIG. 2. The lavatory basin A15 has a drain A16 and A17 is the tail piece between the drain at the bottom of the vessel and the p-trap A27. The hatched area of the p-trap is the water seal A28. The p-trap is made of drainage fittings connected to the bottom of the vessel, and provide both the water trap and water seal for the fixture. This is similar in almost all other fixtures.

Figure 1:
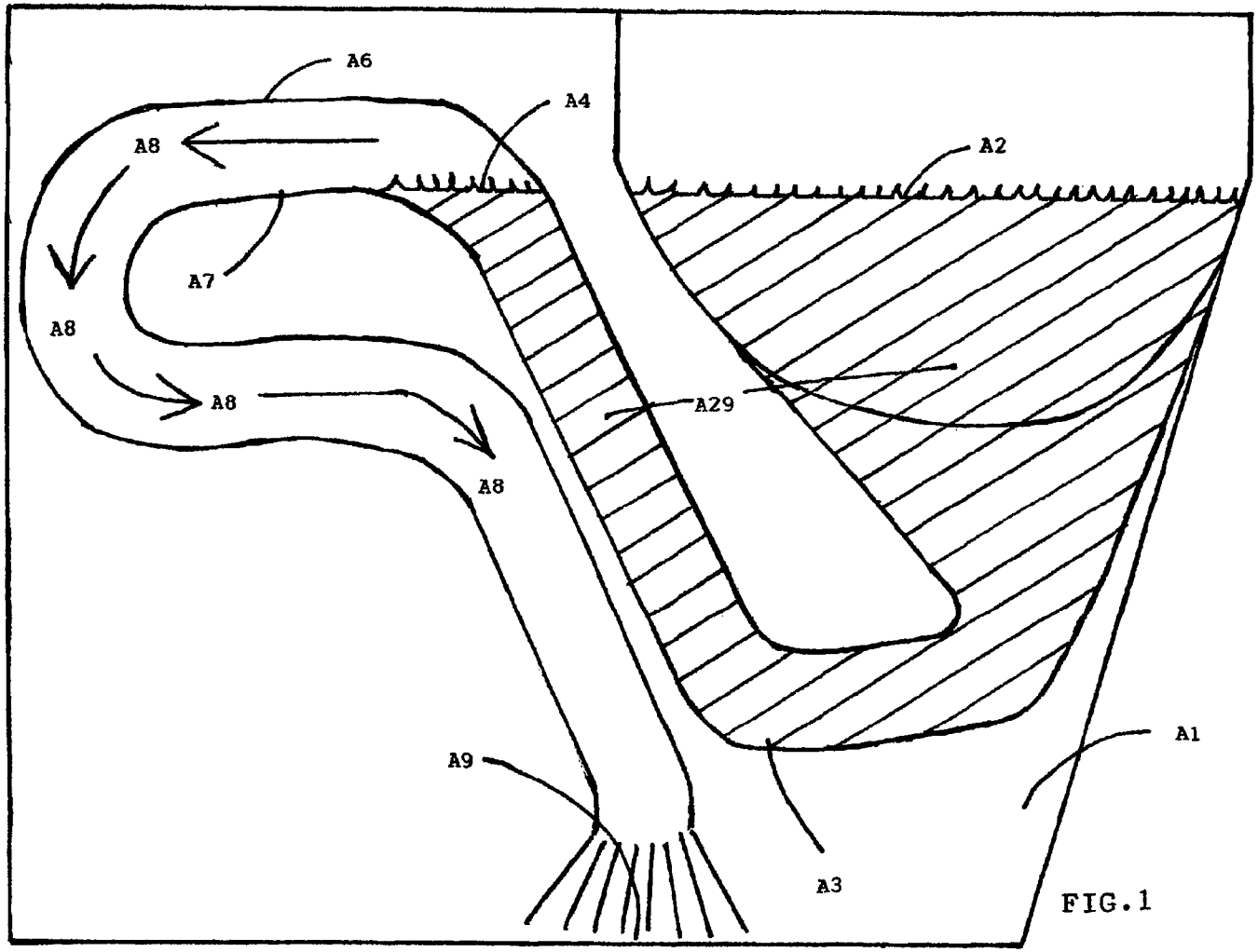
FIG. 1 PRIOR ART
FIG. 1 Is an elevation side view of a toilet bowl, showing the common design used by all toilets. The water seal is provided by a water trap that is an integral part of the casting of the toilet bowl.

However the water closet is the exception. It's water trap & water seal are not provided by drainage fittings connected to the bottom of the vessel, but have an internal water trap A6 and water seal A29 provided by the toilet bowl itself. In the prior art over the last 50 years, most toilets have been cast in porcelain and designed with an internal tubular pathway to provide the water trap A6 and water seal A29. As is illustrated in FIGS. 1 & 2 the water trap & water seal start in the toilet bowl at the weir of the water seal A2 and travel down to the lowest point in the water seal A3, then up to the weir of the water seal in the water trap A4. The pathway of the water trap continues over the weir of the trap A7 and following the arrows of A8 continues down to A9 the waste depository, through the bottom of the toilet bowl and into the closet bend A10, the first drainage fitting it reaches.

It is the trap of the toilet bowl that requires toilets to be flushed with 11/2 gals. of clean portable water to convey the contents of the bowl and trap to the sewer system A14. Flushing pushes the contents of the toilet down the bowl, up the trap A6 and over the weir A7 of the trap. In effect flushing raises the waste higher than the weir of the trap A7. It's all downhill from there, it is the raising of the waste that requires the wasteful use of so much clean water.

The replacement I have designed for the toilet, uses a slipjoint water trap 6, not an internal, integral part of the casting of the toilet bowl. It is a separate and distinct piece that is cast separately, it is tubular in design and configured similar to a question mark on its back. The tubular trap is then connected to the toilet bowl by two slipjoint connecters 19 & 20. It is this slipjoint water trap that provides the means by which the contents of the toilet can be drained off into the sewer without flushing the toilet.

The embodiment of my replacement for the toilet is the slipjoint water trap 6 which when rotated 90 degrees from the vertical allows the contents of the toilet bowl and trap to be drained off into the sewer system A14. In effect I have designed a means of lowering the weir 7 of the water trap instead of raising the waste. No flushing is necessary and no toilet tank needed. It is the force of gravity exerted on the waste itself that draws the waste into the sewer system, once the trap is rotated 90 degrees from the vertical the trap weir 7 is now below the lowest point in the water seal point 3. Under these circumstances the weir has been eliminated and the waste has no place to dam up.

Figure 8:
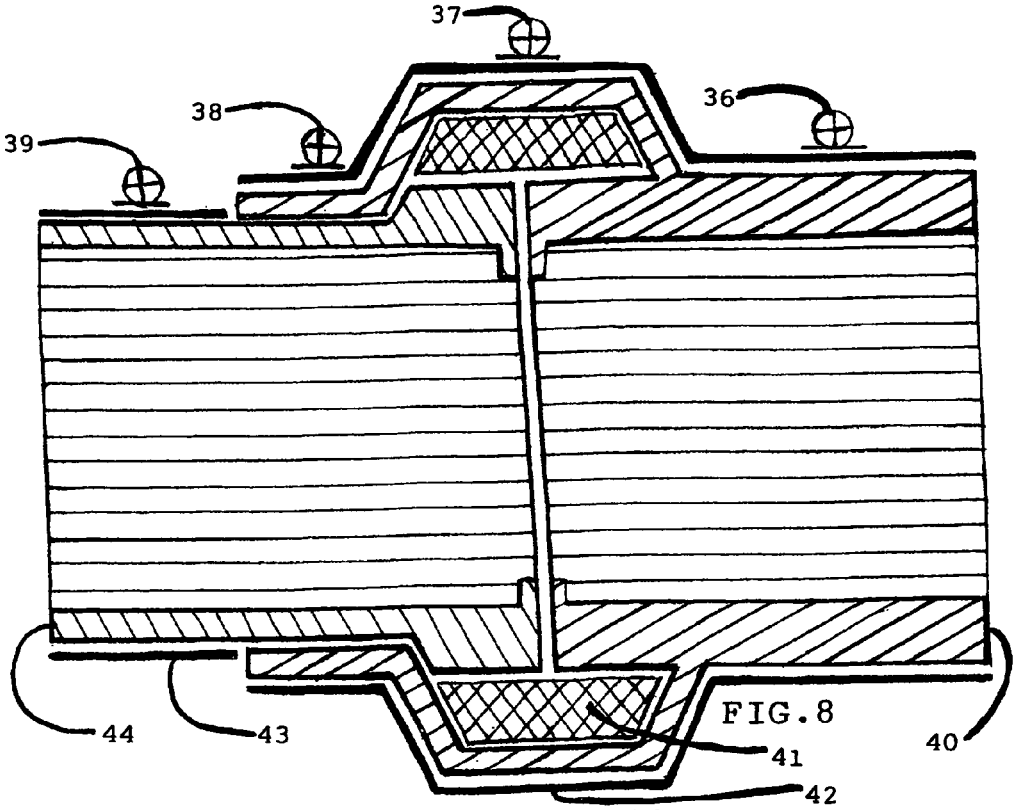
FIG. 8 Is a sectional view of the slipjoint connecter in FIG. 7 viewed from sectional view markings.
Figure 7:
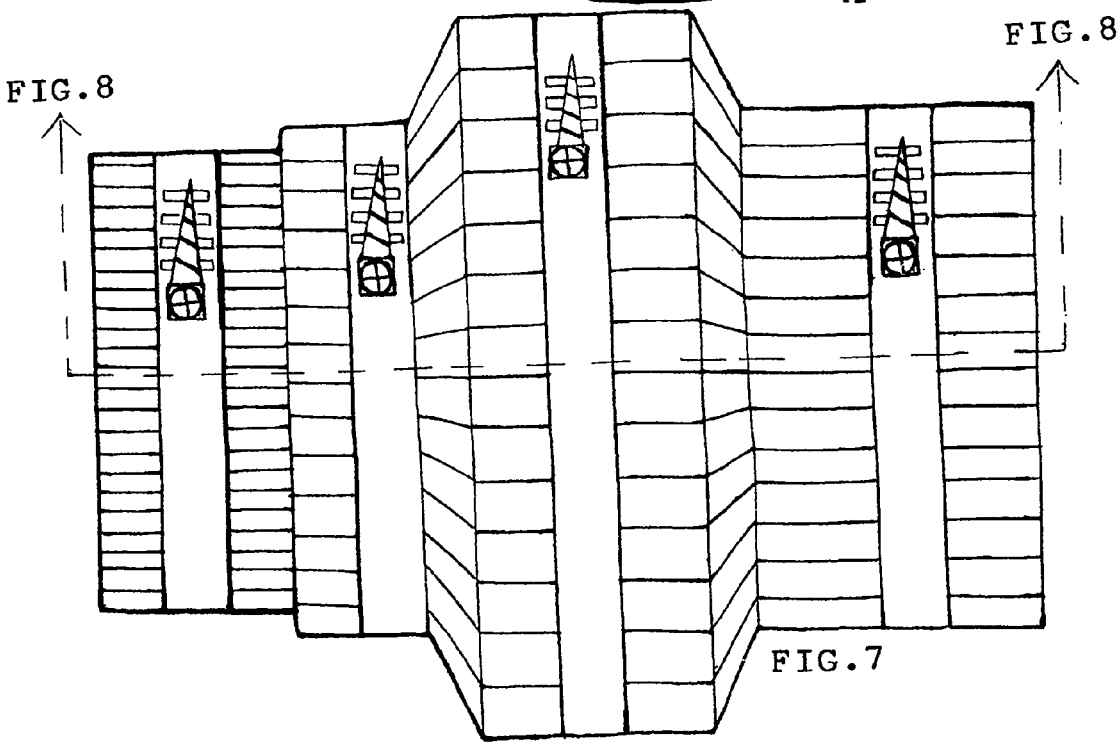
FIG. 7 Is an enlarged detailed view of the slipjoint connecter.

The slipjoint water trap 6 is connected to the toilet bowl by 2 slipjoint connecters 19 & 20. Each slipjoint connecter has five separate parts. Each has three rubber seals 40, 41 & 44. Each also has two sheet metal bands 42 & 43. Band 42 has three clamps 36, 37 & 38, band 43 has only one clamp 39 as illustrated in FIG. 8.

In assembling the fixture the barrel of the toilet bowl outlet 10 mates up with the barrel of the slipjoint water trap inlet 13 and the barrel of the slipjoint water trap outlet 17 mates up with the barrel of the waste depository inlet 14.

The four faces of the lets 11, 12, 15 & 16 all share a common axis which tilts 2% downhill from the horizontal, and each face of the lets is perpendicular in both dimensions to the common axis 18. This arrangement insures that the slipjoint water vtrap will be in full, firm, and complete contact at all times with the toilet bowl lets, even during the rotation function of the slipjoint water trap.

In assembling the fixture the smaller of the two tube shaped seals 44 of each connecter is fitted to the slipjoint water trap. The larger of the two tube shaped seals 40 of each connecter is fitted to the toilet bowl lets. The first seal 40 is fitted to the barrel of the toilet bowl outlet 10 and the first seal 44 is fitted to the barrel of the water trap inlet 13. The third seal of each connecter is the donut shaped seal 41 which fits in-between the two tube shaped seals in the slipjoint area of the connecter where it bridges the gap between the two ends.

The second seal 44 is fitted to the barrel of the water trap outlet 17 and the second seal 40 is fitted to the barrel of the waste depository inlet 14 then the second seal 41 is fitted in the slipjoint area of the second connecter.

The slipjoint side of the first connecter is firmly attached to the barrel of the water trap inlet 13 by band 43 and hose clamp 39. This connection is stationary in relation to the water trap, so that as the water trap 6 rotates, so does this side of the connection. And that part of the trap inlet 13 and that part of seal 44 that is not under the band 43 and hose clamp 39 has a male orientation so that it slips inside the slipjoint center of the connecter. The side of the connecter designed to receive and enclose the water trap inlet, is connected to the barrel of the toilet bowl outlet 10 by seal 40, band 42 and by hose clamps 36, 37 & 38. This side of the connection does not rotate with the water trap, but remains stationary at all times in relation to the toilet bowl outlet.

The two clamps 37 & 38 around the slipjoint area of the connecter are only tightened enough to hold a water tight fit, but soft enough to allow for the rotation of the slipjoint water trap. The interior surfaces of the seals in the slipjoint area of the connecter will be lubricated with a non-petroleum based lubricant, to promote rotation of the slipjoint water trap.

Disassembly of the connecters and removal of the trap will allow for inspection, service and/or replacement of the water trap.

The toilet assembly begins with the toilet bowl 1 and the slipjoint water trap 6. The bowl of the toilet has an outlet 10 and a waste depository inlet 14. The toilet bowl outlet 10 mates up with the slipjoint water trap inlet 13 and the waste depository inlet 14 mates up with the slipjoint water trap outlet 17.

We connect the slipjoint water trap to the toilet bowl using two slipjoint connecters. The first connecter 19 is used to join the water trap inlet 13 to the toilet bowl outlet 10 with the slipjoint side of the connecter fitted to the water trap inlet 13. The second connecter 20 is used to join the water trap outlet 17 to the waste depository inlet 14 of the toilet bowl, with the slipjoint side of the connecter fitted to the water trap outlet.

Once the toilet bowl 1 and the slipjoint water trap 6 are assembled a ziplock strap 24 is attached to the top of the trap, the strap has two connection loops one on the side of the trap closest to the body of the toilet bowl where the return spring mechanism 22 is connected to one loop 23 and the other end of the spring is attached to the bowl at 21. The other loop of the strap is connected to the draw down cable 26 at loop 25.

When the trap is rotated counter clock-wise towards the floor, to 90 degrees from the vertical during the draining function the return spring mechanism 22 will return the trap back to the vertical position, once the handle is released.

The draw down cable 26 is the mechanism used to rotate the slipjoint water trap 6 counter clock-wise 90 degrees from the vertical. In rotating the slipjoint water trap the weir of the trap is being lowered, when the slipjoint water trap is rotated 90 degrees from the vertical the weir and the water trap are temporarily eliminated, dis-established or become non-existent and the waste does not dam up. During this draining function the lowest point in the water seal 3 has now become a high point in the incline pathway to the sewer system.

In effect I have devised a mechanism that lowers the weir of the trap below the water seal so that the entire pathway from the bottom of the bowl to the sewer has a 2% incline and the fixture empties with only the force of gravity exerted on the waste itself.

Lowering the weir 7 of the slipjoint water trap 6 below the water seal 5, instead of raising the waste above the weir 7 of the trap 6, is accomplished by rotating the slipjoint water trap on its common axis 18. The draw down cable 26 is attached at one end to the loop 25 of the zip-lock strap 24. The cable then runs down towards the floor and through the first cable guide 27 and then through the second cable guide 28. It turns towards the back of the toilet and using the fastener 29 attaches to the toilet handle 35. About half way up the toilet handle is the fastener 30 that secures the toilet handle to the back of the toilet and also serves as a pivot point for the handle to engage the draw down cable 26.

When the top of the toilet handle is moved counter clock-wise the cable is drawn through the cable guides and pulls the top of the slipjoint water trap down towards the floor, until it reaches 90 degrees from the vertical. After draining the toilet bowl the handle is released and the return spring mechanisms 22 & 32 draw the slipjoint water trap and toilet handle back to the vertical position.

The second return spring mechanism 32 is secured to the back of the toilet bowl at one end 31 and the other end of the spring attaches to the toilet bowl handle 35, above the pivot point 30 where it draws the handle back to the vertical position once the draining function is complete and the handle is released.

The water valve 34 is mounted at the back of the toilet. When the handle is in the vertical position the valve and valve trigger are right up against the toilet bowl handle 35. When the handle is moved counter clock-wise the valve 34 opens and feeds water to the toilet bowl, to rinse the face of the bowl while the toilet is draining.

Figure 4:
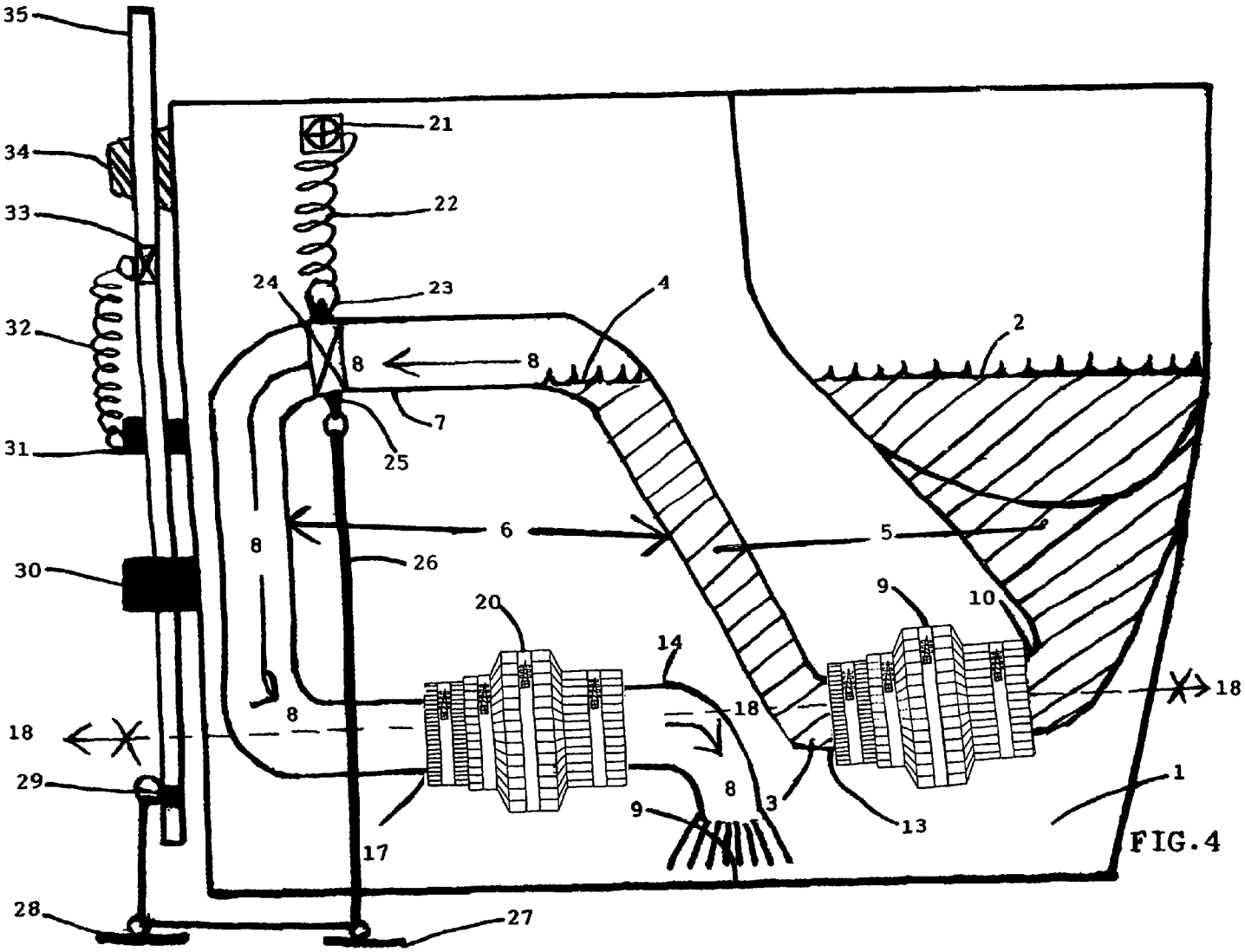
FIG. 4 Is the same bowl with all the other necessary components to complete the improvement, showing the slipjoint water trap in the vertical position and the water seal established.
Figure 5:
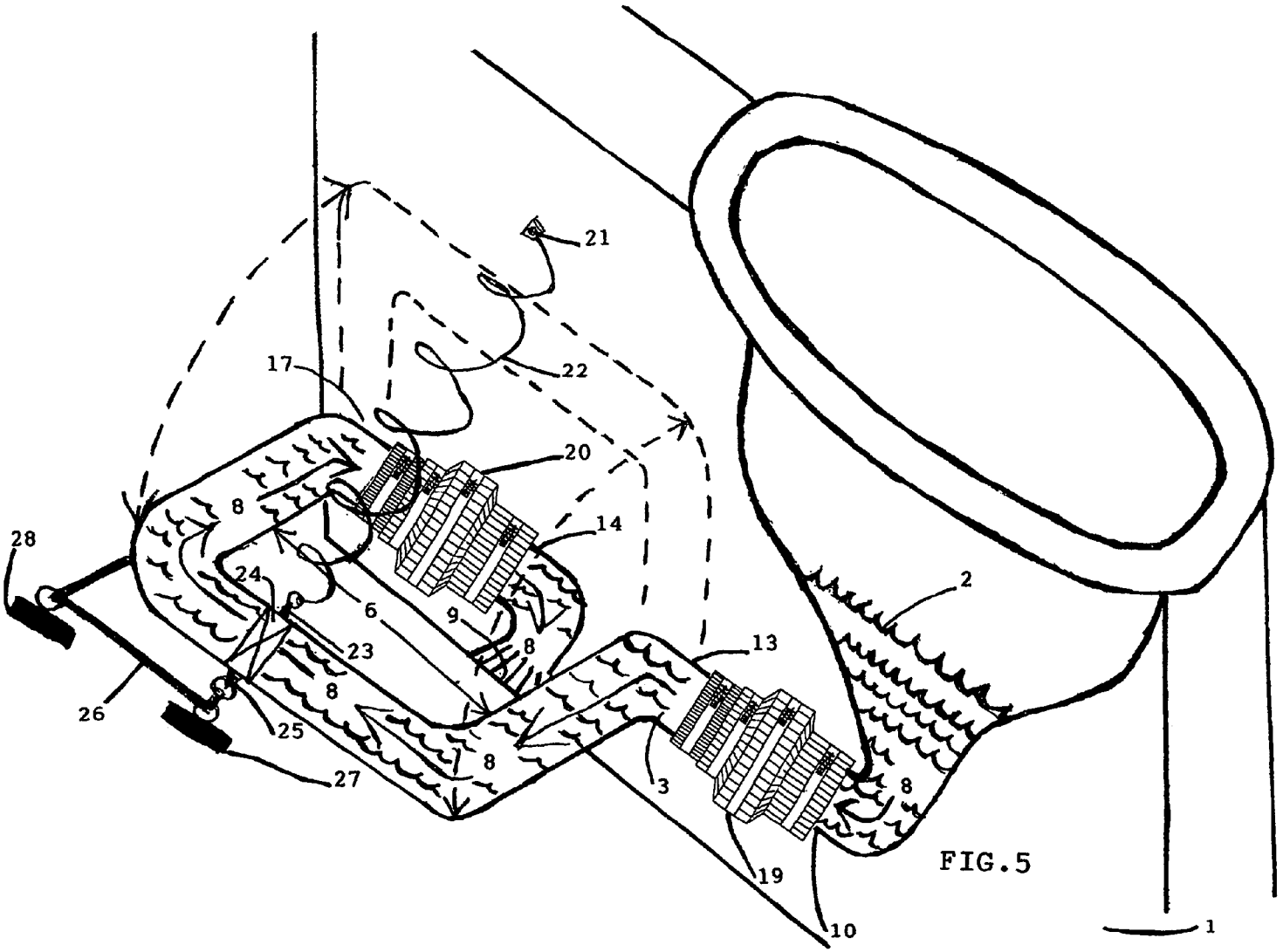
FIG. 5 Is the same bowl viewed from just above and slightly in front. This perspective view of my design shows the slipjoint water trap in the lowered position during the draining cycle.
Figure 6:
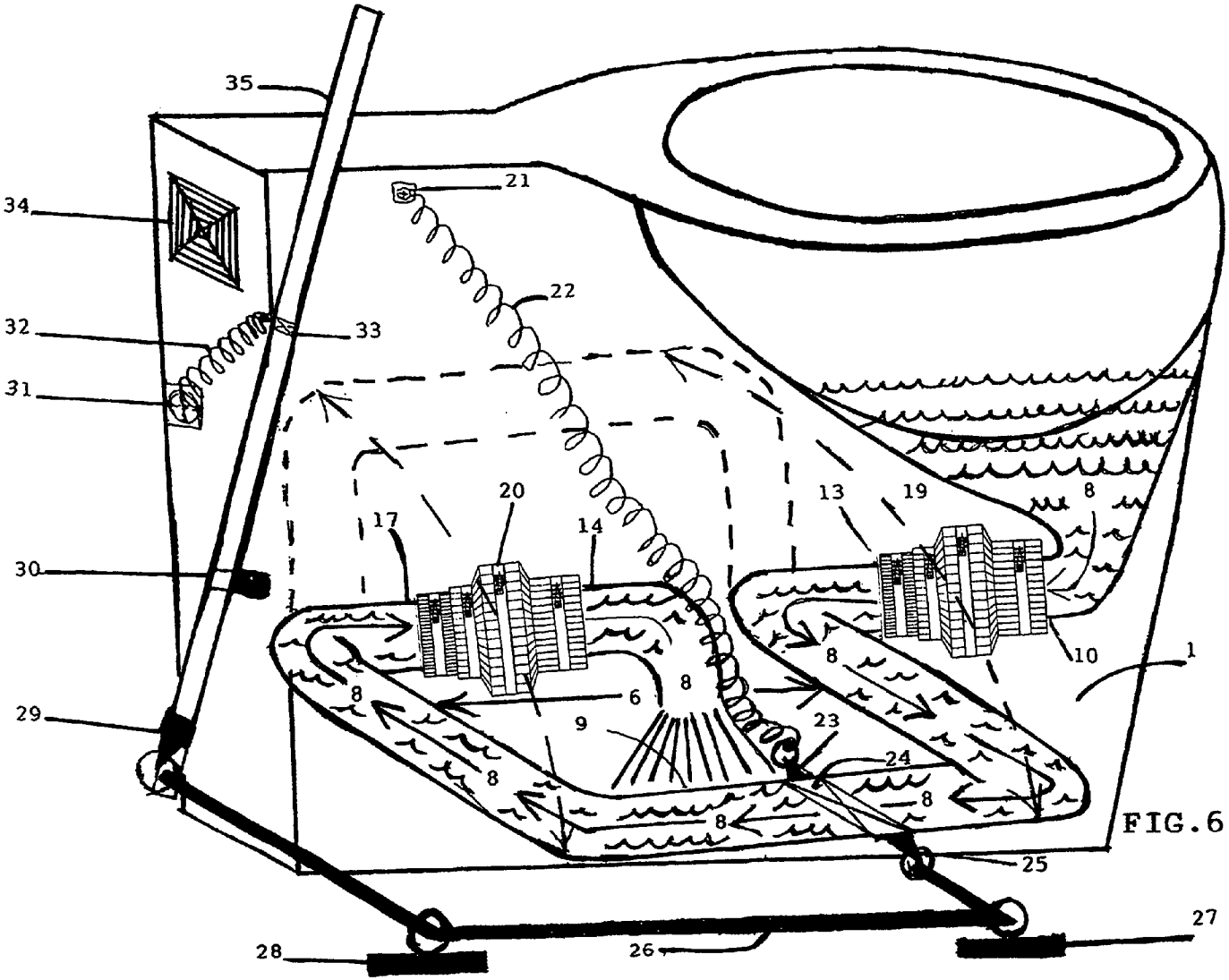
FIG. 6 Is a perspective view of my design taken from slightly above and slightly to the rear. This view shows all the components and positions during the draining cycle.

Once the handle is released the return spring mechanism 32 draws the handle back to the vertical position and return spring mechanism 22 returns the slipjoint water trap back to the vertical, but the water valve 34 remains open and continues to feed water to the toilet bowl until the water seal 5 (IN THE HATCH AREA OF FIG. 4) is re-established in the toilet bowl and slipjoint water trap.

The face of the barrel of the toilet bowl outlet 11, the face of the barrel of the slipjoint water trap inlet 12, the face of the barrel of the water trap outlet 16 and the face of the barrel of the waste depository inlet 15 are all perpendicular in both dimensions to the common axis 18.

The invention claimed is:

1. A toilet and drainage assembly comprising:

a bowl having an open upper end and a lower end with an outlet pipe having an axis;

a waste depository pipe substantially coaxial with the axis, the waste depository pipe having an inlet opening;

a water trap located between the outlet pipe and the inlet opening of the waste depository pipe, the water trap comprising a bowl connector pipe substantially coaxial with the axis and connectable to the outlet pipe, a waste depository connector pipe substantially coaxial with the axis and connectable to the inlet opening of the waste depository pipe, and an intermediate pipe between the bowl connector pipe and the waste depository pipe, the intermediate pipe having an outwardly extending portion;

a first joint between the outlet pipe and the bowl connector pipe of the water trap;

a second joint between the waste depository connector pipe of the water trap and the inlet opening of the waste depository pipe;

a mechanism for rotating the water trap between the first joint and the second joint between a first position in which the outwardly extending portion of the intermediate pipe is at a high point and a second position in which the outwardly extending portion of the intermediate pipe is moved through approximately 90 degrees; and the outlet pipe is slightly elevated relative to the waste depository pipe.

2. A toilet and drainage assembly as claimed in claim 1 wherein the axis is approximately 2 degrees relative to the horizontal, and the outlet pipe is slightly elevated relative to the waste depository pipe.

3. A toilet and drainage assembly as claimed in claim 1 wherein the waste depository pipe has an outlet opening which discharges into a waste depository.

4. A toilet and drainage assembly as claimed in claim 1 wherein the intermediate pipe of the water trap has a rising portion adjacent the bowl connector pipe, a substantially horizontal portion adjacent the rising portion and a descending portion between the horizontal portion and the waste depository connector pipe.

5. A toilet and drainage assembly as claimed in claim 4 wherein the horizontal portion of the water trap is above the lower end of the outlet pipe when in the first position so that a water seal is formed between the bowl and the water trap when in the first position.

6. A toilet and drainage assembly as claimed in claim 4 wherein the horizontal portion of the water trap is approximately level with the outlet pipe of the bowl in the second position so that there is no water seal formed between the bowl and the water trap when in the second position.

7. A toilet and drainage assembly as claimed in claim 1 wherein the mechanism for rotating the water trap between the first position and the second position comprises a strap connector mounted on the intermediate pipe of the water trap, a cable attached to the strap connector, and a handle for operating the cable.

8. A toilet and drainage assembly as claimed in claim 7 further comprising a spring attached to the strap connector at one end and an attachment site at the other end, the spring biasing the intermediate pipe so that the water trap is normally held in the first position.

9. A toilet and drainage assembly as claimed in claim 8 further comprising cable guides for the cable between the strap connector and the handle.

10. A toilet and drainage assembly as claimed in claim 9 wherein the handle is pivoted at a point between its ends so that pivoting of the handle about the point pulls the cable to cause movement of the water trap from the first position to the second position.

11. A toilet and drainage assembly as claimed in claim 10 wherein the handle is in a rest position in which it is substantially vertical, and a spring biases the handle into the rest position.

12. A toilet and drainage assembly as claimed in claim 1 further comprising a water valve which is activated to discharge water into the bowl when the water trap is moved from the first position to the second position.

13. A toilet and drainage assembly as claimed in claim 12 wherein the water valve remains activated after the water trap is moved from the second position to the first position so as to partially fill the bowl.

14. A toilet and drainage assembly as claimed in claim 1 wherein the first joint is a slip joint having a fixed portion connected to the outlet pipe of the water bowl and a pivoting portion connected to the bowl connector pipe of the water trap.

15. A toilet and drainage assembly as claimed in claim 1 wherein the second joint is a slip joint having a fixed portion connected to the inlet opening of the waste depository pipe and a pivoting portion connected to the waste depository connector pipe of the water trap.

16. A toilet and drainage assembly as claimed in claim 1 wherein the water trap can be easily removed at the first and second joints to facilitate inspection and maintenance thereof.

17. A toilet and drainage assembly comprising:

a bowl having an open upper end and a lower end with an outlet pipe having an axis at a level;

a waste depository pipe substantially coaxial with the axis, the waste depository pipe having an inlet opening;

a water trap located between the outlet pipe and the inlet opening of the waste depository pipe, the water trap comprising a bowl connector pipe substantially coaxial with the axis and connectable to the outlet pipe, a waste depository connector pipe substantially coaxial with the axis and connectable to the inlet opening of the waste depository pipe, and an intermediate pipe between the bowl connector pipe and the waste depository pipe, the intermediate pipe having an outwardly extending portion;

a first joint between the outlet pipe and the bowl connector pipe of the water trap;

a second joint between the waste depository connector pipe of the water trap and the inlet opening of the waste depository pipe;

a mechanism for rotating the water trap between the first joint and the second joint between a first position in which the outwardly extending portion of the intermediate pipe is at least partially raised above the level of the axis and a second position in which the outwardly extending portion of the intermediate pipe is at substantially the level of the axis; and the outlet pipe is slightly elevated relative to the waste depository pipe.

* * * * *